United States Patent [19]

Gannaway

[11] Patent Number: 4,757,696

[45] Date of Patent: Jul. 19, 1988

[54] SUCTION ACCUMULATOR HAVING SLIDE VALVE

[75] Inventor: Edwin L. Gannaway, Adrian, Mich.

[73] Assignee: Tecumseh Products Company, Tecumseh, Mich.

[21] Appl. No.: 63,306

[22] Filed: Jun. 17, 1987

[51] Int. Cl.[4] ..... F25B 43/00

[52] U.S. Cl. ..... 62/503; 62/383

[58] Field of Search ..... 62/503, 383

[56] References Cited

U.S. PATENT DOCUMENTS

| | | | |
|---|---|---|---|
| 1,746,406 | 2/1930 | Sawyer | 62/503 |
| 1,885,836 | 11/1932 | Kellogg et al. | 62/518 |
| 3,180,567 | 4/1965 | Quiggle et al. | 417/372 |
| 3,232,073 | 2/1966 | Jobes et al. | 62/471 |
| 3,412,574 | 11/1968 | Reiter | 62/471 |
| 3,563,053 | 2/1971 | Bottum | 62/503 |
| 3,609,990 | 10/1971 | Bottum | 62/503 |
| 3,626,715 | 12/1971 | Bottum | 62/503 |
| 3,796,064 | 3/1974 | Ladusaw | 62/503 |
| 4,583,377 | 4/1986 | Viegas | 62/503 |
| 4,653,286 | 3/1987 | Huenniger | 62/503 |

FOREIGN PATENT DOCUMENTS

| | | |
|---|---|---|
| 935193 | 10/1955 | Fed. Rep. of Germany . |
| 154850 | 12/1979 | Japan . |

*Primary Examiner*—Ronald C. Capossela

*Attorney, Agent, or Firm*—Jeffers, Hoffman & Niewyk

[57] ABSTRACT

A suction accumulator for the compressor of a refrigeration system is disclosed in which a suction tube connected to the outlet of the accumulator extends vertically within the accumulator vessel and has liquid metering openings located adjacent to the bottom of the vessel and as gas inlet openings located adjacent to the top of the vessel between the liquid metering openings and the accumulator outlet along the length of the suction tube. A float valve member surrounds the suction tube and is slidable along the vertical length thereof. In response to the accumulation of liquid refrigerant, the valve member covers the gas inlet openings to prevent introduction of liquid refrigerant therethrough. Extension of the gas inlet opening along the vertical length of the suction tube provides progressive opening and closing by the valve member in response to changes in liquid accumulation.

19 Claims, 4 Drawing Sheets

SUCTION ACCUMULATOR HAVING SLIDE VALVE

The present invention relates to a refrigerant storage vessel located inline between the evaporator and the compressor in a refrigeration system. More particularly, the invention relates to a suction accumulator which separates the liquid components of the refrigerant from the gaseous components thereof and provides a storage or sump for the liquid refrigerant.

Most compressors adapted for use in refrigeration systems are designed for the compression of gaseous refrigerant. Under some circumstances, however, it is not unusual for a certain amount of liquid to flow from the evaporator into the inlet of the compressor. This condition, which is often referred to as slugging, may occur after the system is shut down and, if an accumulator is not provided, large quantities of condensed refrigerant return through the suction line to the crankcase of the compressor. When the compressor is restarted, the large quantity of liquid refrigerant present therein results in abnormally high pressures which frequently cause blown gaskets, broken valves, etc.

Suction accumulators, which are well known in the art, prevent this from occurring by providing a sump or storage for liquid refrigerant at the inlet to the compressor. A common type of accumulator comprises a vessel having a generally U-shaped tube received therein, one end of which is connected to an outlet pipe or tube extending into the vessel and the other end of which is open to the interior of the vessel. As the incoming liquid refrigerant flows into the vessel, it collects in the bottom thereof whereas the gaseous component is carried off through the U-tube in the outlet. A bleed-through orifice in the wall of the U-tube, located in the lower portion of the vessel, meters a small quantity of liquid refrigerant into the stream of gaseous refrigerant flowing through the tube so that a larger slug of refrigerant is not introduced into the inlet of the compressor on start-up or during operation thereof. Such accumulators may furthermore provide for pressure equalization whereby the pressure at the outlet of the suction accumulator is equalized with the pressure in the liquid storage vessel to prevent higher pressures in the liquid from forcing liquid refrigerant into the suction inlet of the compressor when the compressor is turned off.

In the aforementioned accumulator having a U-shaped tube, a problem arises in that liquid refrigerant may enter the end of the tube open to the vessel when a surge of liquid refrigerant is returning to the accumulator. Furthermore, slugging upon start-up can occur as a result of liquid refrigerant having entered the bleed-through orifice and collected in the U-tube.

Various improvements have been proposed for the U-tube accumulator to improve its ability to prevent slugging at start-up and during extreme conditions of liquid refrigerant entering the accumulator during compressor operation. For instance, a trap chamber in association with the accumulator outlet and capable of receiving all of the liquid within the U-tube has been used. Furthermore, for those instances when the trap chamber is not sufficient in capacity to handle all of the liquid refrigerant which may be injected thereinto, a float valve element has been utilized located within the U-tube leg connected to the chamber and accumulator outlet. Specifically, a disc-like valve element is pivotally mounted within the suction tube at a location near the upper portion of the tube adjacent to the suction outlet. When closed, the valve element effectively turns the refrigeration system off until the level of liquid within the accumulator subsides. The valve disc diameter is made slightly less than the inner diameter of the tube in order to allow leakage thereby for automatic restart of the refrigeration system. One problem associated with this type of float valve arrangement for a suction accumulator is that a separate liquid trap chamber is required.

Another disadvantage of suction accumulators utilizing a U-tube design is that they do not provide slug-free operation under all conditions. As illustrated by the provision of a trap chamber, efforts to improve the effectiveness of an accumulator having a U-tube have resulted in larger accumulators, which is undesirable. Also, a continuing problem with U-tube accumulators having an orifice located near the bottom of the vessel for scavenging oil is that they tend to require additional means for avoiding slugging during start-up.

Problems have also presisted in attempts to use valving in suction accumulators. For instance, a valve having a typical valve seal arrangement operates in an abrupt fashion to open and close the valve. This results in undesirable instantaneous changes to the load on the compressor and compressor motor. Also, these same valves having valve seats are susceptible to being held closed longer than required as continued suction is drawn on the valve after closure. Furthermore, the aforementioned mechanical valve structure used in accumulators is susceptible to mechanical wear and failure.

SUMMARY OF THE INVENTION

The present invention overcomes the disadvantages of the above-described prior art suction accumulators by providing an improved suction accumulator for a refrigeration system.

It is desired to provide a suction accumulator that exhibits improved separation of the gas and liquid components of the incoming refrigerant and that minimizes the amount of liquid refrigerant that enters the compressor on start-up and during operation when a large volume of liquid refrigerant enters the accumulator.

Specifically, it is desired to provide a suction accumulator assembly having improved valving means to prevent slugging in a compressor at start-up and during operation when a large volume of liquid refrigerant enters the accumulator.

Accordingly, the present invention provides a suction accumulator located inline between the evaporator and the compressor in a refrigeration system and having a suction tube disposed therein, wherein valve means responsive to the accumulation of liquid refrigerant in the accumulator prevents the liquid refrigerant from entering the compressor through a gas inlet opening in the suction tube.

More specifically, in accordance with one form of the present invention, a storage vessel having an inlet and an outlet is provided for storing liquid and gaseous refrigerant in a refrigeration system. Attached to the vessel outlet and disposed within the vessel is a conduit having a gas inlet opening and a liquid metering opening. During normal operation of the accumulator, gaseous refrigerant within the vessel is drawn into the conduit through the gas inlet opening and carried to the compressor via the vessel outlet. A float valve responsive to the accumulation of liquid refrigerant in the vessel covers the gas inlet opening when excessive liquid refrigerant enters the vessel through the inlet. Once the gas inlet opening is covered, back pressure acting upon the liquid metering opening draws liquid refrigerant into the conduit at a controlled rate so that the liquid refrigerant is vaporized before entering the compressor.

One advantage of the suction accumulator of the present invention is that liquid refrigerant introduced into the accumulator storage vessel during compressor operation is prevented from entering the compressor.

Another advantage of the present invention is that slugging during start-up is eliminated.

Yet another advantage of the present invention is that a trap chamber is not required, thereby reducing the cost and space requirements of the accumulator.

Another advantage of the present invention is that reduced tubing length is required as compared to an accumulator using a U-shaped tube, thereby reducing manufacturing costs.

A further advantage of the present invention is that accumulator valving is provided that does not cause abrupt on/off control of the accumulator outlet to the compressor.

Yet another advantage of the present invention is the virtual maintenance-free operation of the valving mechanism.

A further advantage of the present invention is that the valve of the present invention is not held closed by continued suction being drawn from the compressor.

A yet further advantage of the suction accumulator of the present invention is that the structure associated therewith is easily assembled.

The invention in one form thereof, provides a suction accumulator for a compressor of a refrigeration system. The suction accumulator includes a storage vessel having a vessel inlet and a vessel outlet. The vessel stores gaseous and liquid refrigerant introduced through the vessel inlet for drawing out through the vessel outlet. The volume of liquid refrigerant accumulated in the bottom of the vessel varies during operation of the refrigeration system. The accumulator also includes a conduit disposed within the vessel, which has an end opening connected to the vessel outlet, a gas outlet opening located toward the top of the vessel for communication with the gaseous refrigerant, and a liquid inlet opening located toward the bottom of the vessel for communication with the liquid refrigerant. The accumulator further includes valve means, responsive to the accumulation of liquid in the vessel, for covering the gas inlet opening.

The invention further provides, in one form thereof, a suction accumulator for a compressor of a refrigeration system comprising a storage vessel, having a top end and a bottom end with respect to its operative position, an inlet for the storage vessel, and an outlet for the storage vessel. The outlet comprises a suction tube having a first end portion adjacent to the top end of the vessel and a second end portion. The first end portion extends through the vessel to the exterior thereof, and the second portion extends vertically within the vessel substantially coaxially with the vertical axis of the vessel. The suction accumulator also includes a liquid metering opening located in the second end portion of the suction tubing adjacent to the bottom end of the vessel. The suction accumulator further includes a gas inlet opening in the second end portion of the suction tubing located between the liquid metering opening and the first end of the suction tubing. Valve means, responsive to the accumulation of liquid in the vessel, are provided for covering the gas inlet opening.

The invention further provides, in one form thereof, a suction accumulator for a compressor of a refrigeration system comprising a refrigerant storage vessel, a conduit disposed within the vessel, and a valve member. The refrigerant storage vessel has an inlet and an outlet and stored liquid and gaseous refrigerant. The conduit has a suction opening connected to the vessel outlet, a liquid metering opening located adjacent to the bottom of the vessel, and a gas inlet opening. The gas inlet opening is located in a valve length of the conduit extending substantially coaxially with the vertical axis of the vessel. Furthermore, the gas inlet opening is located toward the top of the valve length. The valve member is floatable in liquid refrigerant and surrounds the conduit so as to be slidingly engaged therewith for covering the gas inlet opening. The valve member is disposed within the valve length and rests toward the bottom thereof when the volume of liquid refrigerant in the vessel is insufficient to buoy the valve member. The valve member is vertically displaced toward the top of the valve length by the accumulation of liquid refrigerant in the vessel so as to cover the gas inlet opening.

These and other objects of the present invention will become apparent from the detailed description taken together with the accompanying drawings.

Figure 1:
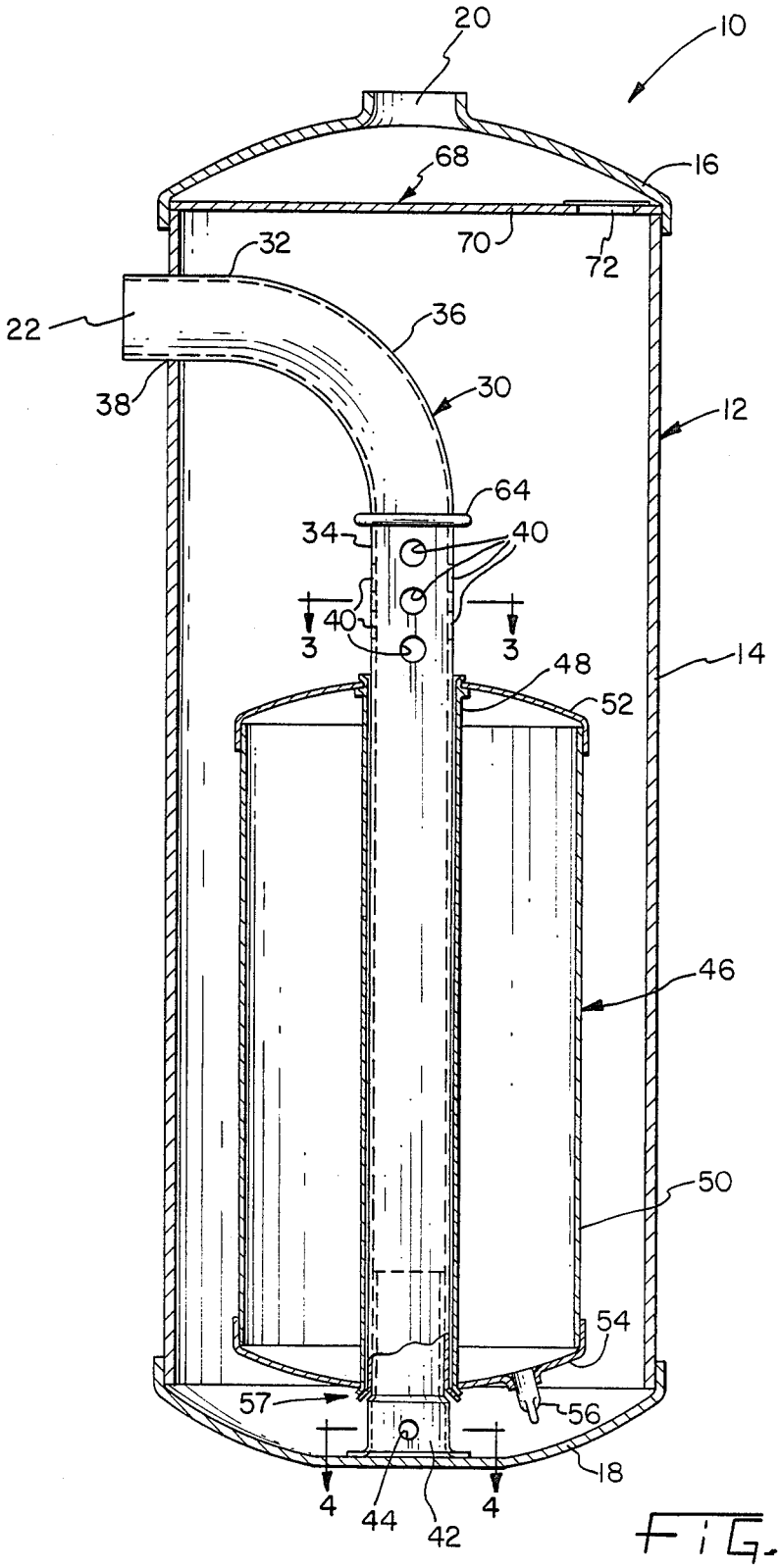
FIG. 1 is a sectional view of a suction accumulator according to the present invention.
Figure 7:
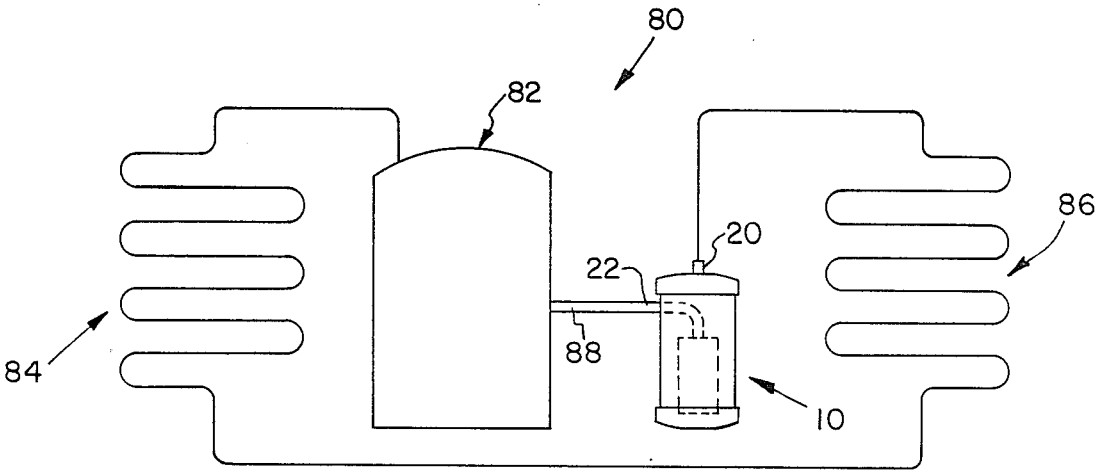
Figure 6:
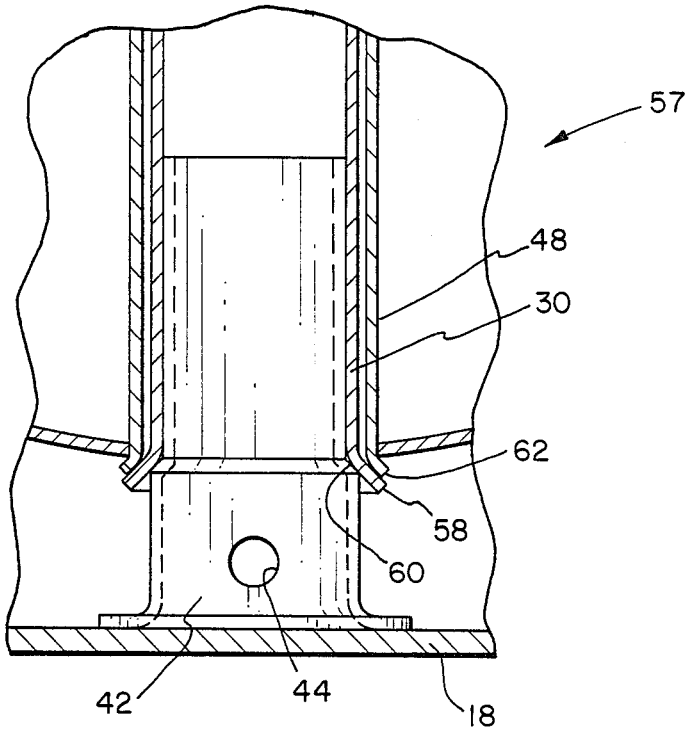

FIGS. *5a–5c* are sectional views of a suction accumulator according to the present invention, particularly showing progressive movement of the valve member as the vessel accumulates liquid refrigerant;

FIG. 6 is an enlarged fragmentary sectional view of the suction accumulator of FIG. 1, particularly showing lower stop means for the valve member; and FIG. 7 is a diagrammatic representation of a refrigeration system incorporating a suction accumulator according to the present invention.

DESCRIPTION OF THE PREFERRED EMBODIMENT

Referring now to FIG. 1, a suction accumulator 10 is shown oriented in its operative, vertical upright position. Accumulator 10 includes a storage vessel 12 comprising a tubular casing 14, a top end wall 16, and a bottom end wall 18. Tubular casing 14 may be either cylindrical, as shown, or some other suitable shape. Suction accumulator 10 also includes an inlet 20 and an outlet 22.

Disposed within storage vessel 12 is a conduit, such as suction tube 30, having an upper end portion 32 and a lower end portion 34. In the embodiment shown in FIG. 1, a bend or elbow 36 is provided between substantially straight end portions 32 and 34, thus allowing end portion 32 to extend through tubular casing 14 to the exterior of vessel 12. Suction tube 30 is secured to tubular casing 14 by means of soldering or brazing or the like, as at 38, and forms a sealed connection with tubular casing 14 to prevent escape of gas or liquid from accumulator 10.

Figure 3:
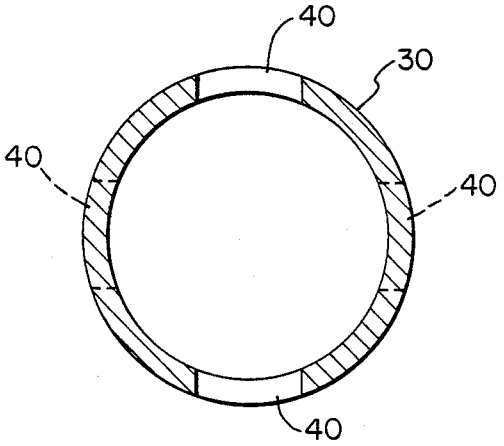
FIG. 3 is an enlarged partial sectional view of FIG. 1 taken along the line 3—3 and viewed in the direction of the arrows, particularly showing gas inlet holes in the suction tube.

Lower end portion 34 extends vertically within vessel 12 substantially coaxially with the vertical axis thereof. A gas inlet opening to the interior of suction tube 30 is provided in the embodiment shown in FIG. 1 by a plurality of gas inlet holes 40. As illustrated in FIGS. 1 and 3, gas inlet holes 40 are spaced both vertically along and circumferentially about suction tube 30. In the preferred embodiment of the present invention, ten 0.250 inch diameter holes are provided in the tubing. However, any opening or combination of openings providing area approximately equal to the cross-sectional area of suction tubing 30 may be used. Holes were chosen in the preferred embodiment for ease of manufacture. Furthermore, locating the holes at right angles retains the structural strength of suction tube 30.

Figure 4:
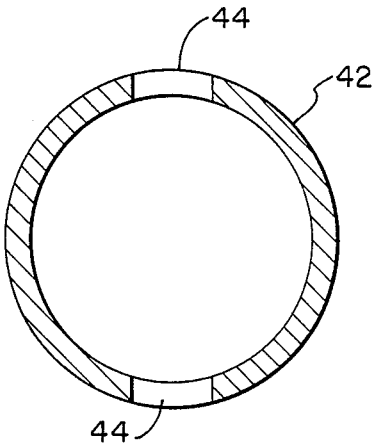
FIG. 4 is an enlarged partial sectional view of FIG. 1 taken along the line 4—4 and viewed in the direction of the arrows, particularly showing liquid metering openings in the standpipe.

At the bottom end of lower end portion 34, suction tube 30 is connected to a hollow standpipe 42. Suction tube 30 is slip fit over standpipe 42 to provide sealed fluid communication therewith. A liquid inlet opening is provided in standpipe 42, taking the form of a plurality of liquid metering openings 44 located near the bottom of storage vessel 12 adjacent to bottom end wall 18. As shown in FIG. 4, the illustrated embodiment includes two liquid metering openings 44 located opposite one another in the sidewall of cylindrical standpipe 42. In the preferred embodiment, two 0.187 inch diameter holes are used, thus making the area of the gas inlet opening greater than the area of the liquid inlet opening by a factor of approximately nine.

Suction accumulator 10 further comprises a valve member 46 surrounding suction tube 30 and being slidingly engaged therewith. In one embodiment of the present invention, wherein slide member 46 is a hermetically sealed valve float, member 46 comprises a sleeve member, such as collar 48, having attached at opposite ends thereof a top end piece 52 and a bottom end piece 54. A cylindrical shell member 50 is disposed between end pieces 52, 54, and is attached at the outer extremeties thereof. Valve member 46 also includes a vacuum seal 56 used during manufacturing of member 46 to draw a vacuum on the interior thereof.

As previously described, lower portion 34 of suction tube 30 extends vertically within vessel 12 substantially coaxially with the vertical axis thereof. Valve member 46 is slidingly engaged with lower portion 32 and may be displaced along the length thereof. A lower stop means 57 is provided to prevent valve member 46 from travelling to the bottom of vessel 12 so as to cover liquid metering openings 44. Referring to FIG. 6, lower stop means 57 comprises a flare 58 on the end of suction tube 30 that is slip fit over standpipe 42. Flare 58 rests on a shoulder 60 of standpipe 42 when suction tube 30 is assembled over standpipe 42. An annular rim 62 on the bottom edge of collar 48 rests on flare 58 when valve member 46 has reached its lower limit of travel. As shown in FIG. 6, when valve member 46 is seated against lower stop means 57, liquid metering openings 44 remain uncovered.

An upper stop means 64 on lower end portion 34 of suction tube 30 prevents valve member 46 from being displaced along the length of suction tube 30 beyond a point at which gas inlet holes 40 are completely covered by collar 48 of valve member 46. In one embodiment of the present invention, upper stop means 64 consists of a annular ring soldered, brazed, or otherwise attached to suction tube 30. Without upper stop means 64, valve member 46 would be free to travel to a position adjacent to bend 36 and possibly become cocked or otherwise stuck, and not be able to travel back down along the length of lower end portion 34 to lower stop means 57.

Figure 2:
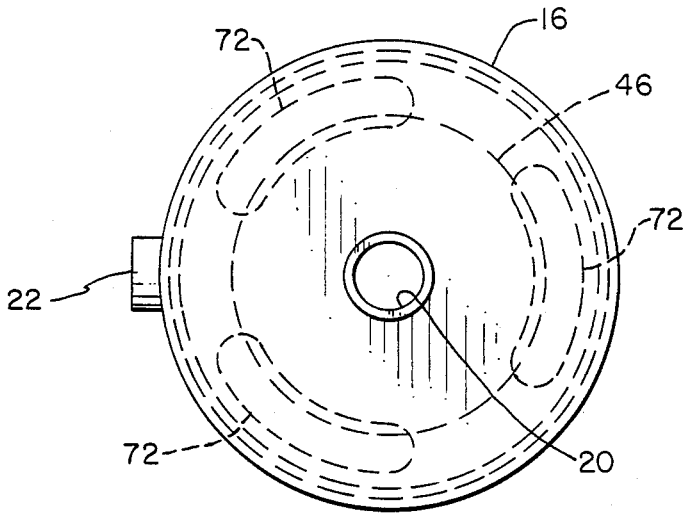
FIG. 2 is a top view of the suction accumulator of FIG. 1.

The suction accumulator of the present invention is provided with a filter 68 located near the top of vessel 12 adjacent to top end wall 16 and inlet 20. Filter 68 includes a screen support 70 and a plurality of screen portions 72 spaced radially outward of the center of screen support 70. Referring to FIG. 2, screen portions 72 are located so that when accumulator 10 is in its operative vertical position, liquid refrigerant entering inlet 20 will be filtered by screen portions 72 and fall so as to hit the outward radial edge of top end piece 52 of valve member 46, or fall along the side thereof. With screen portions 72 spaced radially as shown in FIG. 2, falling liquid refrigerant will be directed away from gas inlet holes 40 located substantially coaxially with the vertical axis of vessel 12.

Suction accumulator 10, according to the present invention, is intended for use in a refrigeration system 80 as shown in FIG. 7. Refrigeration system 80 comprises a compressor 82, a condensor 84, an evaporator 86, and suction accumulator 10. Under certain operating circumstances, liquid refrigerant may flow from evaporator 86 into inlet 20 of suction accumulator 10. Also, condensed refrigerant may be present in storage vessel 12 of accumulator 10 at start-up of refrigeration system 80. Accumulator 10, according to the present invention, assures that only gaseous refrigerant exits accumulator 10 through outlet 22 and enters compressor 82 through suction inlet 88 thereof. This is accomplished by valve member 46 being responsive to the accumulation of liquid refrigerant in vessel 12 to move vertically along lower portion 34 of suction tube 30.

Figure 5C:
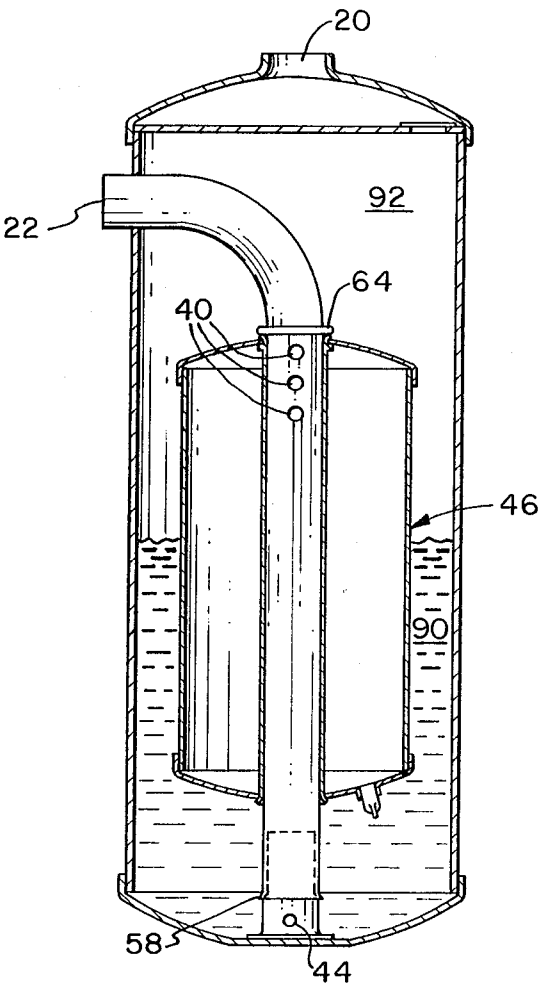
Figure 5B:
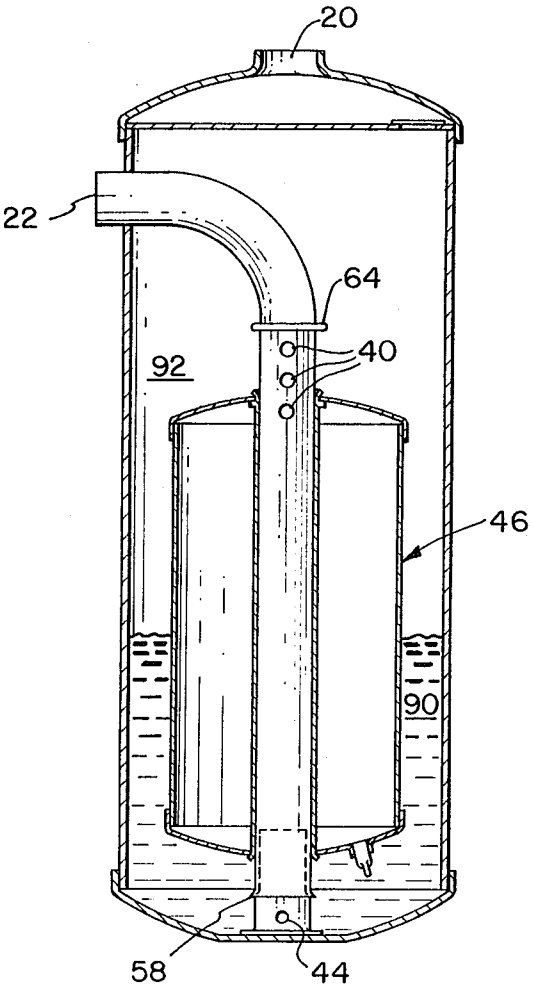
Figure 5A:
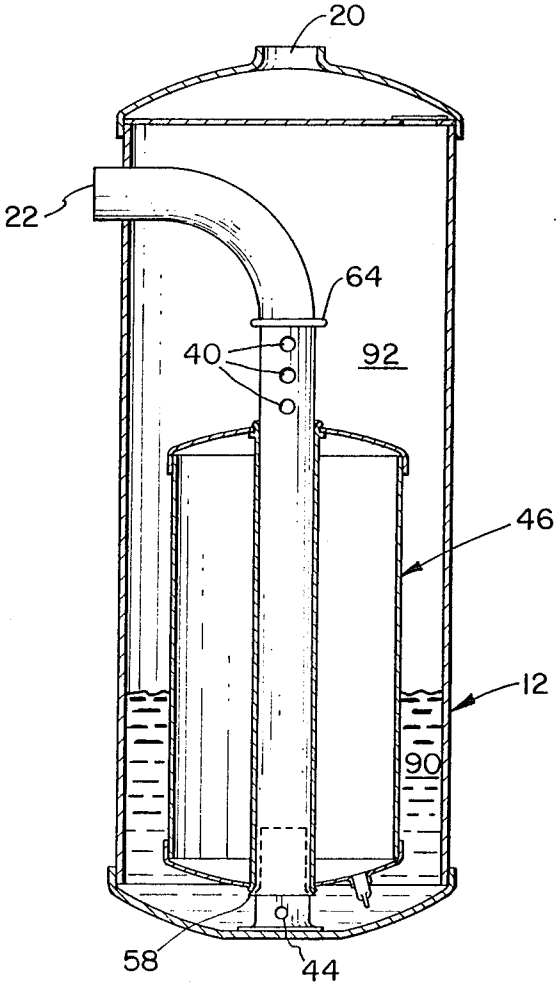

Referring now to FIGS. 5*a* through 5*c*, the operation of suction accumulator 10 is illustrated at various accumulation levels of liquid refrigerant 90. In FIG. 5*a*, an amount of liquid refrigerant 90 insufficient to buoy valve member 46 is present within vessel 12. With valve member 46 in this position, gas inlet holes 40 are open to the interior of vessel 12 to allow gaseous refrigerant 92 to exit through outlet 22. Because the area of gas inlet openings 40 is approximately equal to the cross-sectional area of suction tube 30, little or no back pressure is created on liquid metering openings 44. Therefore, very little liquid refrigerant or oil, if present, is drawn through liquid metering openings 44.

In FIG. 5*b*, the level of liquid refrigerant 90 has increased to a level where valve member 46 has been displaced vertically upward along suction tube 30 so as to cover several of the gas inlet holes 40, thereby drawing increased back pressure on liquid metering openings 44. During operation of the refrigeration system with valve member 46 positioned as in FIG. 5*b*, a mixture of gaseous refrigerant 92 and liquid refrigerant 90 is being drawn into suction tube 30, the liquid refrigerant 90 being vaporized prior to exiting accumulator 10 through outlet 22.

FIG. 5*c* illustrates the position of valve member 46 when the volume of liquid refrigerant 90 in storage vessel 12 is sufficient to buoy valve member 46 and displace it to its extreme upward position where it is stopped by upper stop means 64. In this position, valve member 46 is covering gas inlet holes 40 so that suction drawn by compressor 82 will create back pressure on liquid metering openings 44 sufficient to draw liquid refrigerant into suction tube 30 for vaporization before exiting accumulator 10 through outlet 22. The small metered quantity of liquid refrigerant entering holes 44 allows refrigeration system 80 to continue operating until self-regulation reduces the accumulation of liquid refrigerant 90 in vessel 12, thereby allowing valve member 46 to fall by force of gravity.

While the gas inlet opening in suction tube 30 has been represented as a plurality of gas inlet holes 40, it is contemplated that various designs of openings may be utilized to achieve controlled reduction of the gas inlet opening. For instance, a slotted opening oriented along the vertical axis of suction tube 30 would provide gradual covering of a gas inlet opening as valve member 46 is displaced along suction tube 30. The slot also may have varying width in order to achieve variable rate covering of the gas inlet opening.

It is observed that at start-up of a compressor system according to the present invention, liquid refrigerant collected in the lower end portion 34 of suction tube 30 is prevented from entering the compressor. Either gas inlet holes 40 are open to supply gaseous refrigerant, or holes 40 are closed, thus causing additional liquid to be metered through liquid metering openings 44 and allowing the already present liquid refrigerant to vaporize before entering the compressor.

While the present invention has been described with respect to progressive covering of a gas inlet opening in response to accumulation of liquid refrigerant in a storage vessel of an accumulator, it is understood that analagous progressive opening of the gas inlet opening is achieved as the level of liquid refrigerant in the vessel subsides. In fact, because gravity forces valve member 46 to travel downwardly and uncover gas inlet holes 40, continued suction drawn on suction tube 30 by compressor 82 will not cause gas inlet holes 40 to remain covered.

Valve member 46 is designed such that its weight and size result in proper buoyancy to achieve the desired results in terms of closing gas inlet holes 40 to prevent introduction of liquid refrigerant thereinto. While valve member 46 has been described as a hermetically sealed valve float, it is contemplated that other buoyant materials having a sleeve member attached thereto, such as collar 48, and being floatable in liquid refrigerant could be used.

While the suction accumulator of the present invention has been described with respect to its function of restricting liquid from entering the compressor, it is understood that the described accumulator also filters out contaminants and acts as a suction muffler.

It will be appreciated that the foregoing description of a preferred embodiment of the invention is presented by way of illustration only (and not by way of any limitation) and that various alternatives and modifications may be made to the illustrated embodiment without departing from the spirit and scope of the invention.

What is claimed is:

1. A suction accumulator for a compressor of a refrigeration system, comprising:

a storage vessel having a vessel inlet and a vessel outlet, the vessel adapted for storing gaseous and liquid refrigerant introduced through the vessel inlet for drawing out through the vessel outlet, the volume of liquid refrigerant accumulated in the bottom of the vessel varying during operation of the refrigeration system;

a conduit, disposed within the vessel, having an end opening connected to the vessel outlet, a gas inlet opening means located toward the top of the vessel for communication with the gaseous refrigerant, and a liquid inlet opening means located toward the bottom of the vessel for communication with the liquid refrigerant; and valve means, responsive to the accumulation of liquid in the vessel, for covering the gas inlet opening means.

2. The accumulator of claim 1 in which:

the valve means and the gas inlet opening means cooperate to provide controlled reduction of the area of the gas inlet opening means as a function of the volume of liquid refrigerant in the vessel.

3. The accumulator of claim 1 in which:

the gas inlet opening means is located between the vessel outlet and the liquid inlet opening means along the length of the conduit.

4. The accumulator of claim 3 in which:

the valve means and the gas inlet opening means cooperate to provide controlled reduction of the area of the gas inlet opening means as a function of the volume of liquid refrigerant in the vessel.

5. The accumulator of claim 1 in which:

a first end of the conduit is connected to the vessel outlet to provide fluid communication therewith, and a second end of the conduit is attached to the bottom of the vessel, the liquid inlet opening means being located adjacent to the bottom of the vessel and the gas inlet opening means being located above the liquid inlet opening means between the vessel inlet and the liquid inlet opening means along the length of the conduit.

6. The accumulator of claim 5 in which:

the valve means includes a valve member surrounding the conduit and being slidingly engaged therewith, the valve member being operable to cover the gas inlet opening means when displaced upwardly along the longitudinal axis of the conduit by the liquid refrigerant.

7. The accumulator of claim 6 in which:

the area of the gas inlet opening means is extended along the longitudinal axis of the conduit to provide controlled reduction of the area as the valve member is displaced along the conduit.

8. A suction accumulator for a compressor of a refrigeration system comprising:

a storage vessel having a top end and a bottom end with respect to its operative position;

an inlet for the storage vessel;

an outlet for the storage vessel comprising a suction tube having a first end portion adjacent to the top end of the vessel and extending through the vessel to the exterior thereof and a second end portion extending vertically within the vessel substantially coaxially with the vertical axis of the vessel;

a liquid metering opening means in the second end portion adjacent to the bottom end of the vessel;

a gas inlet opening means in the second end portion located between the liquid metering opening means and the first end portion; and valve means, responsive to the accumulation of liquid in the vessel, for covering the gas inlet opening means.

9. The accumulator of claim 8 in which:

the valve means comprises a sleeve member axially disposed about the suction tube and being slidable along the second end portion thereof in response to changes in the volume of liquid refrigerant in the vessel.

10. The accumulator of claim 9 in which:

the area of the gas inlet opening means is distributed along the longitudinal axis of the second end portion to cause gradual reduction of the area of the gas inlet opening means as the sleeve member is caused to slide over and cover the gas inlet area in response to accumulation of liquid in the vessel.

11. The accumulator of claim 10 and further comprising:

stop means for preventing the sleeve member from sliding over and covering the liquid metering opening means.

12. The accumulator of claim 8 in which:

the second end portion comprises a stand pipe, attached to the bottom end of the vessel, to which the suction tube is coupled, the liquid metering opening means being located in the stand pipe adjacent to the bottom end.

13. The accumulator of claim 8 in which the inlet for the storage vessel is located in the top end substantially coaxially with the vertical axis of the vessel, and further comprising:

dispersing filtering means located between the top end and the gas inlet opening means for dispersing, radially with respect to the second end portion of the suction tubing, the liquid refrigerant entering the vessel through the vessel inlet.

14. The accumulator of claim 13 in which:

the valve means comprises a sleeve member axially disposed about the suction tube and being slidable along the second end portion thereof in response to changes in the volume of liquid refrigerant in the vessel.

15. A suction accumulator for a compressor of a refrigeration system, comprising:

a refrigerant storage vessel for liquid and gaseous refrigerant having an inlet and an outlet;

a conduit, disposed within the vessel, having a suction opening connected to the outlet, a liquid metering opening means located adjacent to the bottom of the vessel, and a gas inlet opening means located in a valve length of the conduit extending substantially coaxially with the vertical axis of the vessel, the gas inlet opening means being located toward the top of the valve length; and a valve member, floatable in the liquid refrigerant, surrounding the conduit and being slidingly engaged therewith for covering the gas inlet opening means, the valve member being disposed within the valve length and resting toward the bottom thereof when the volume of liquid refrigerant in the vessel is insufficient to buoy the valve member, the valve member being vertically displaced toward the top of the valve length by the accumulation of liquid refrigerant in the vessel to cover the gas inlet opening means.

16. The accumulator of claim 15 in which:

the area of the gas inlet opening means is distributed along the longitudinal axis of the valve length to cause a gradual reduction of the area of the gas inlet opening means as the valve member is caused to slide over and cover the gas inlet area in response to accumulation of liquid in the bottom of the vessel.

17. The accumulator of claim 16 in which:

the conduit is cylindrical tubing and the gas inlet opening means comprises a plurality of holes in the tubing spaced both circumferentially about the tubing and along the longitudinal axis thereof.

18. The accumulator of claim 16 and further comprising:

stop means on the conduit for limiting the upward and downward travel of the valve member, the valve member being limited in its downward travel to prevent covering of the liquid metering opening means and being limited in its upward movement to prevent uncovering of the gas inlet opening means.

19. The accumulator of claim 15 in which:

the valve member is a hermetically sealed float.

* * * * *